United States Patent [19]

Kim

[11] Patent Number: 4,796,585

[45] Date of Patent: Jan. 10, 1989

[54] VACUUM ADVANCE REGULATOR FOR A SPARK IGNITION ENGINE

[76] Inventor: Sang H. Kim, 36-6 Songjung-Dong, Sungdong-Ku, Seoul, Rep. of Korea

[21] Appl. No.: 923,384

[22] Filed: Oct. 27, 1986

[30] Foreign Application Priority Data

Oct. 31, 1985 [KR] Rep. of Korea ..... 8122

[51] Int. Cl.[4] ..... F02P 5/10

[52] U.S. Cl. ..... 123/409

[58] Field of Search ..... 123/407, 409

[56] References Cited

U.S. PATENT DOCUMENTS

| | | | |
|---|---|---|---|
| 2,009,933 | 7/1935 | Mallory | 123/407 |
| 2,093,524 | 9/1937 | Meade | 123/407 |
| 2,274,316 | 2/1942 | Arthur | 123/409 |
| 2,650,581 | 9/1953 | Short | 123/409 |
| 3,638,626 | 2/1972 | Marshall | 123/409 |
| 3,930,515 | 1/1976 | Kennedy | 123/409 |
| 4,091,778 | 5/1978 | Okabayashi | 123/409 |
| 4,112,888 | 9/1978 | Okabayashi | 123/409 |
| 4,151,818 | 5/1979 | Tateno | 123/409 |
| 4,158,349 | 6/1979 | Goto | 123/409 |
| 4,198,937 | 7/1980 | Suzuki | 123/409 |
| 4,241,751 | 12/1980 | Nonoyama | 123/409 |
| 4,458,712 | 7/1984 | Stevenson | 123/409 |

*Primary Examiner*—Andrew M. Dolinar

*Attorney, Agent, or Firm*—Albert O. Cota

[57] ABSTRACT

A vacuum advance regulator designed to control the suction force of the vacuum that is applied to the vacuum advancer. The suction, in turn, controls the spark timing and allows combustion to occur when the crank position is at 12 degrees at the ATDC, thus, producing maximum engine power efficiency. The regulator consists of a body (1) containing in part, a vacuum chamber (2) that is connected to the outside of the body by a pair of nipples (3) that are inserted through a first bore (4) and a second bore (4'). The other side of the nipples are connected to a vacuum hose (11). One side of this hose is connected to the vacuum advancer while the other side is connected to the carburetor. The vacuum advance regulator also includes a pair of parallel adjustable throttles (5) and (5') that are in-line with the vacuum chamber (2). The two adjustable throttles provide the adjustment means that allows the vacuum force to set the spark timing.

2 Claims, 5 Drawing Sheets

VACUUM ADVANCE REGULATOR FOR A SPARK IGNITION ENGINE

TECHNICAL FIELD

The invention pertains in general to engine vacuum advance regulators and more particularly to a vacuum advance regulator for use on a spark ignition engine that is installed in series with the engine vacuum line between the vacuum advancer and the carburetor.

BACKGROUND ART

To have optimum engine combustion, the spark timing of an engine must be precisely controlled. On a typical four cylinder, 1,400 cc gasoline engine with a compression ratio of 9:1, the combustion position at which the combustion of fuel can produce the maximum power output is when the crank is at 12-degrees at the After-Top Dead-Center (ATDC). If the sparking timing is controlled to allow the combustion to occur at the above ATDC, maximum power output will be produced at a fixed amount of fuel consumption regardless of the variations in the gasoline octane rating, engine speed, and load.

When the mixed gas in the engine combustion chamber is ignited, the combustion spreads outwardly from the ignition point after an inherent delay time. The delay time is primarily dependent upon the fuel octane value, the mix ratio of the fuel, and the compression ratio. The delay time does not vary with the changing of the engine speed and load. Therefore, the rotation angle of the crank determines the proper angle of the spark advance.

Conventional spark timing advance systems are comprised of a weight advancer and a vacuum advancer. The weight advancer functions by a centrifugal force and a spring. When the engine rotation speed increases, the weight is displaced outwardly by the centrifugal force and thus advances the spark timing. The vacuum advancer is comprised of a vacuum chamber having on one side a diaphragm on which a lever is connected. When the diaphragm moves, the lever moves the brake pointer plate in compliance with the vacuum pressure, and thus advances the spark timing.

A conventional vacuum advancer is shown in FIG. 1. These conventional advancers are designed to advance the spark by using a combination of engine speed and vacuum. Generally, these advancers are not able to cause combustion to occur at a position of maximum efficiency under all driving conditions. Therefore, much energy is wasted. A characteristic graph of all the driving conditions is shown in FIG. 5. The figure indicates that proper advancing is not achieved with conventional systems and that an improvement is needed.

Repeated experiments conducted by the inventor indicates that the graph should form a straight line as shown in FIG. 6. In FIG. 7, three curves a, b and c are shown. The curve "a" illustrates the most suitable spark timing where combustion occurs at maximum efficiency. The curves "b" and "c" illustrate two cases of a delayed spark timing. In both of these curves, the delivered power output is less than that provided by curve "a".

DISCLOSURE OF THE INVENTION

The vacuum advance regulator is designed to control the spark timing to allow the engine combustion to occur at the ATDC at 12 degrees under all driving conditions as shown in FIG. 8.

The invention improves the defects inherent in conventional advance systems, and controls the spark timing more precisely. As shown in FIG. 2, the regulator is connected by a vacuum hose, in series, between the advancer of the distributor and the carburetor. The suction force of the vacuum which is varied and controlled by the position of the carburetor throttle valve is normally fed directly to the vacuum advancer. With the inventive method, the vacuum is passed through the inventive vacuum advance regulator where the force of the vacuum is controlled at a calculated measure before it is fed to the vacuum advancer. Thus the spark timing is controlled to cause the combustion to occur at the optimum 12 degree position of ATDC under all driving conditions.

BEST MODE FOR CARRYING OUT THE INVENTION

Figure 6:
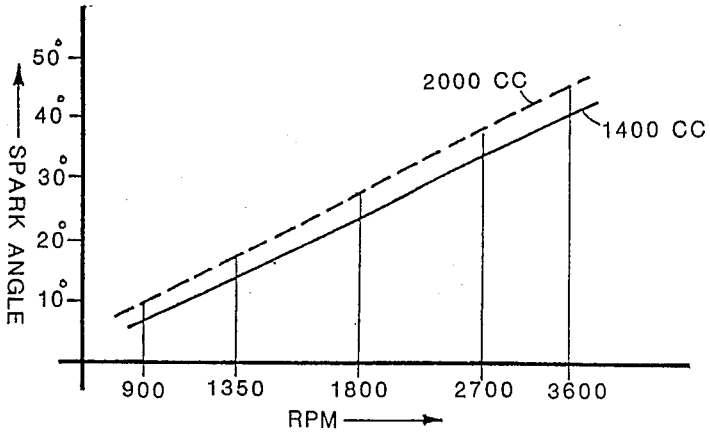
FIG. 6 is a graph showing the characteristics of a vacuum advance system incorporating the inventive vacuum advance regulator.
Figure 7:
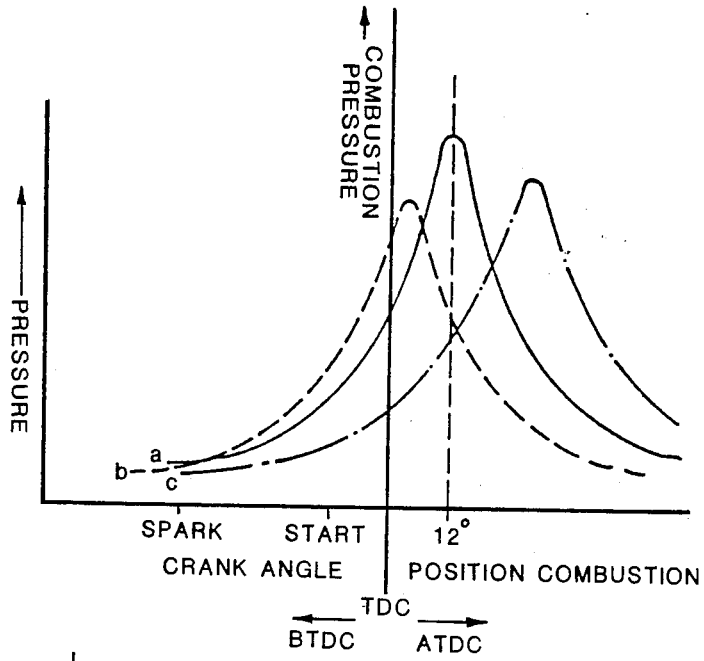
FIG. 7 is a graph showing the relationship between the explosion of fuel and power output.
Figure 8:
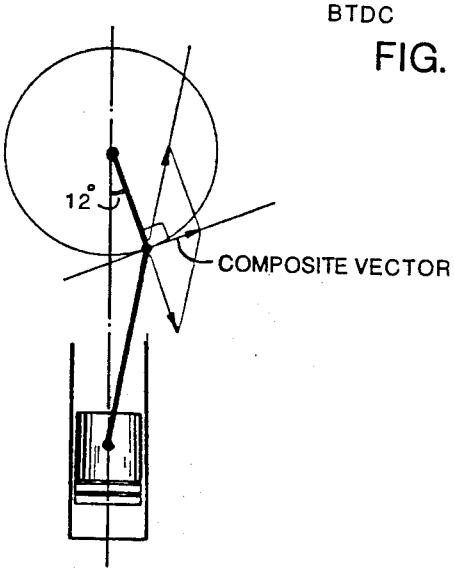
FIG. 8 is a diagram showing the composite vector line of the crank and connecting rod.

The vacuum advance regulator is designed to increase the power efficiency of a gasoline engine by adjusting a first valve 5 and a second valve 5'. The valve adjustment allow the characteristics of the spark advance to form a straight line as shown in FIG. 6.

Figure 2:
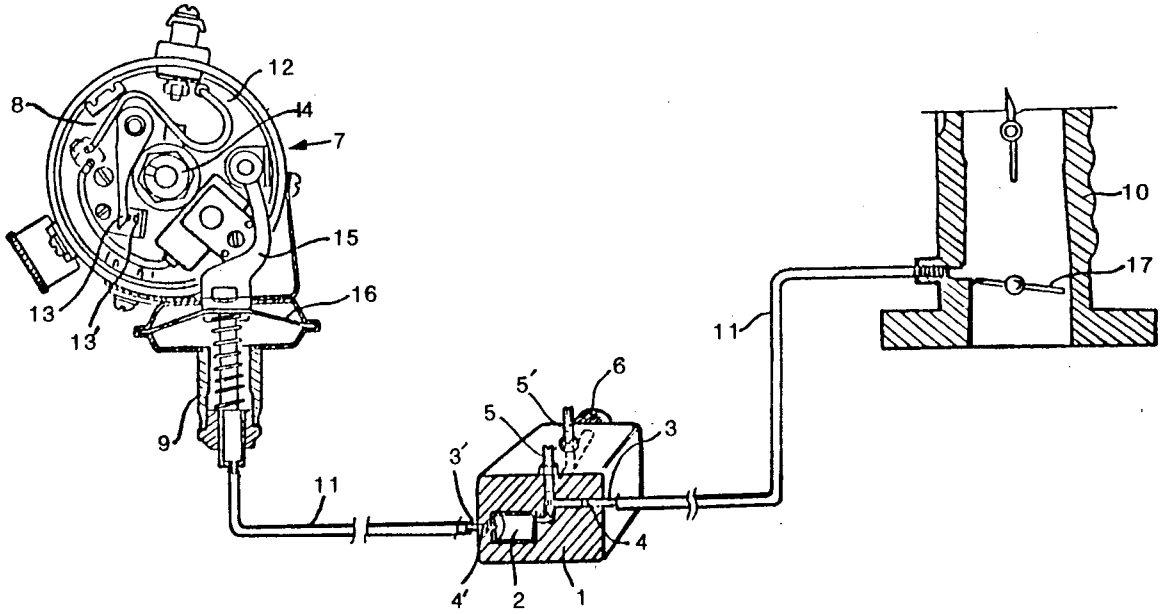
FIG. 2 is a schematic diagram showing the placement of the inventive vacuum advance regulator into an existing vacuum advance system.
Figure 3:
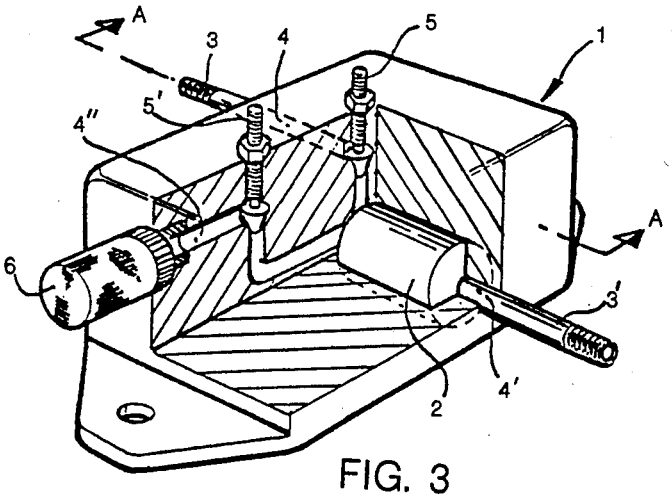
FIG. 3 is a perspective cross sectional view of the vacuum advance regulator.
Figure 4:
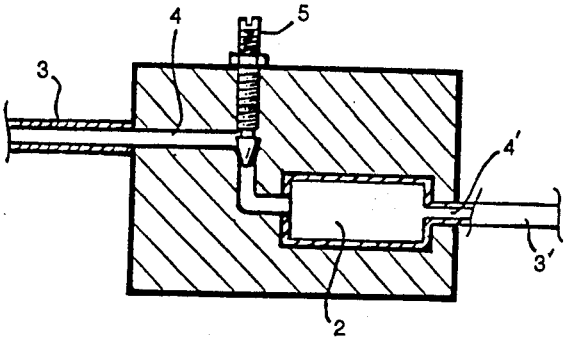
FIG. 4 is a cross sectional view taken along lines A—A of FIG. 3.

The vacuum advance regulator, as best shown in FIGS. 3 and 4, is comprised of the following major elements: a body 1 enclosing a vacuum chamber 2 that is designed to sharply respond to the applied vacuum. The vacuum chamber 2 is connected to the outside of the body by means of a nipple 3 extending from one side of the chamber 2 through a first bore 4 and a nipple 3 extending from the other side of the chamber through a second bore 4'. The other side of the nipple extending from the first bore 4 is connected by means of a vacuum hose 11 to a carburetor 10 and the other side of the nipple attached to the second bore 4' is connected by means of a vacuum hose 11 to the nipple 9 on the vacuum advancer 8. The interconnection of the vacuum advance regulator with the carburetor 10 and the vacuum advancer 8 is shown in FIG. 2.

A first adjustable throttle 5 is installed on top of the body 1. This adjustable throttle is connected in line with the nipple extending from the first bore as best shown in FIG. 3. A second adjustable throttle 5' is also installed on top of the body 1. This adjustable throttle is connected in parallel with the first adjustable throttle 5. The two adjustable throttles function in combination to allow the spark timing to be optimally set in accordance with an equation described infra.

The regulator 1 also includes a third bore 4'' into which is inserted an air filter 6. The filter is connected in-line with the second adjustable throttle 5' as shown in FIG. 3. The air filter prevents dust and similar contaminants from entering the vacuum line.

For reference, in FIG. 2 there is also shown a brake pointer plate 12, contactors 13, 13' a cam 14, a lever 15, a diaphragm 16, and a throttle valve 17.

The vacuum advance regulator is connected and functions as follows: first, connect the high precision tachometer, the timing advance meter and the Co, Nc meter in accordance with the manufacturers instructions.

Warm up the engine to a normal standard temperature and adjust the engine idling speed and exhaust gas according to the engine specifications Adjust the valves 5 and 5' to allow the spark timing at each R.P.M. of 900, 1,800, 2,700 and 3,600 to become the angle that forms a part of the following spark timing equation:

$$\theta(BTDC) = \frac{\left(\beta \times \frac{L}{350} - \beta\right)}{\pi} + \beta$$

where: $\beta$ is the substitution parameter for the following engine speeds:

900 R.P.M. : 8
1,800 R.P.M. : 25
2,700 R.P.M. : 32
3,600 R.P.M. : 39

L is the value of the exhaust volume of the engine divided by the number of cylinders.

For example in the model 1,400 cc engine described supra, the spark timing calculation results in the solid straight line shown in FIG. 6 where the straight line corresponds to the following no-load data:

900 R.P.M. : BTDC 8
1,800 R.P.M. : BTDC 25
2,700 R.P.M. : BTDC 32
3,600 R.P.M. : BTDC 39

With a 2,000 cc, 4 cycle, 4 cylinder engine having a compression ratio of 9:1 and a octane value 85, the spark timing calculated for each speed results in the following no-load values:

900 R.P.M. : BTDC 9.1
1,800 R.P.M. : BTDC 28.4
2,700 R.P.M. : BTDC 36.4
3,600 R.P.M. : BTDC 44.4

The curve for the above is shown as a dotted line in FIG. 6.

After the spark timing chart is prepared, by using the above equation, adjust the valves 5 and 5' to set the advance timing. In actual situations, there are no advance changes until the speed of the engine reaches 1,000 R.P.M., the spark timing at idle is controlled with a spark timing of 900 R.P.M.

The regulator is adjusted under a no-load condition. However, if the mix ratio under a load is dense, the vacuum automatically decreases to comply with the proper advance, and allows combustion to occur. Thus, enabling the engine to achieve maximum power efficiency under any condition of load and speed.

The detailed procedure for adjusting the advance regulator is as follows:

turn the valve 5 in a counter-clockwise direction for approximately three turns, observe the tachometer and record the reading, accelerate the engine speed to 1,800 R.P.M., when the engine speed reaches 1,800 R.P.M. read the advance meter and carefully adjust the valve 5' until the angle is as indicated on the chart, repeat the above procedure at 3,600 R.P.M., when the procedure is repeated three to four times, at a spark timing of 1,800 R.P.M. and 3,600 R.P.M. the spark timing at 2,700 R.P.M. is set automatically. After these settings are completed, the combustion position keeps the ATDC at 12 degrees to produce maximum engine power efficiency under all driving conditions.

The reason why conventional advance systems should be supplemented with the inventive vacuum advance regulator follows.

The recorded time from ignition to combustion of the fuel which is injected into the combustion chamber is normally given as 1/600 second, and the combustion period is 1/1000 second. However, precise tests conducted by the inventor, shows that there is a delay time of 1/500 second, and the spreading time of the combustion flame is 1.5/1000 second.

In any case, the combustion of the fuel requires a certain delay time after ignition by the spark plug. Therefore, to allow a full-scale combustion to occur at 12-degrees at the ATDC, it is necessary to advance the spark timing to comply with the delay time and rotational angle of the crank. The faster the engine rotates, the more the spark timing should be advanced.

Figure 1:
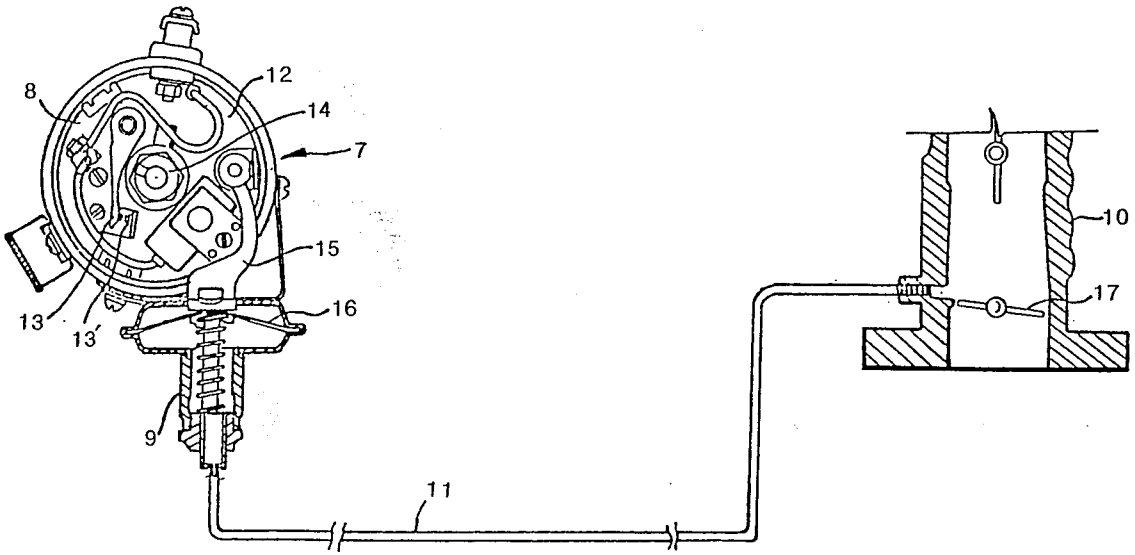
FIG. 1 PRIOR ART
FIG. 1 is a schematic diagram of a conventional vacuum advance system.
Figure 5:
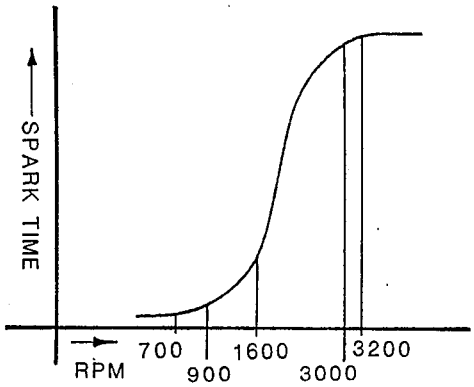
FIG. 5 PRIOR ART
FIG. 5 is a graph showing the characteristics of a conventional vacuum advance system.

In conventional vacuum advance systems, as shown in FIG. 1, the wider the carburetor 10, throttle valve 17 is opened, the more the vacuum pressure increases to pull the diaphragm 16 through the hose 11. Thus, the connecting lever 15 which is connected to the diaphragm 16 pulls the braker plate of the distributor closer to the advance direction causing the contactors 13, 13' to make contact and allowing the cam 14 to synchronously rotate with the rotation of the crank. Thusly, the spark timing is advanced. The conventional system results in the "S" shaped characteristic curve as shown in FIG. 5. With this curve shape, it is impossible to retain a steady advance in proportion to the speed of the engine, resulting in a waste of power efficiency.

With the instant invention, when the advance is controlled by the inventive vacuum advance regulator, the characteristic graph forms a straight line as shown in FIG. 6, the error of advance is corrected, and maximum power efficiency is achieved.

The following test records, shown in Tables I, II and III, were issued by the National Industry Research Institute on Sept. 5, 1985—record number 9188.

TABLE I

| | Specs Fuel efficiency at steady driving (Km/L) | |
|---|---|---|
| Speed (Km/h) | before installation | after installation |
| 50 | 15.9 | 20.1 |
| 60 | 15.7 | 19.1 |
| 70 | 15.1 | 17.8 |
| 80 | 14.5 | 16.7 |
| 90 | 13.4 | 15.4 |

TABLE II

| Tested No. | Specs Fuel efficiency at steady driving (Km/L) before installation | after installation |
|---|---|---|
| 1 | 10.2 | 12.0 |
| 2 | 10.6 | 12.1 |
| 3 | 10.5 | 12.1 |
| 4 | 10.6 | 12.1 |
| 5 | 10.5 | 12.0 |
| Average | 10.5 | 12.0 |

Note 1: This test was performed by using a Chassis dynamometer, in 10 mode test of fuel efficiency by using the exhaust gas test with gasoline in accordance with environmental regulations #84-1, and a one time driving distance of the 10 mode test of 3,120 meters.

Note 2: The test was performed under the following conditions: Before installation of our system: Idle 700 R.P.M., Co 1.7%, spark timing advance −4. After installation of our system: Idle 700 R.P.M., Co 1.7%, spark timing advance −8.

TABLE III

| Speed (Km/H) | Chassis dynamometer load (PS) before installation | after installation |
|---|---|---|
| 20 | 1.17 | 1.17 |
| 40 | 3.78 | 3.78 |
| 50 | 6.30 | 6.23 |
| 60 | 8.40 | 8.38 |
| 70 | 10.93 | 10.85 |
| 80 | 13.85 | 13.70 |
| 90 | 17.03 | 17.08 |

Note 3: The inertia mass was set at 931.46 Kgs before and after installation, and the average load condition for each speed of the chassis dynamometer is as shown in Table III. The driving distance of the test car was 47,722 Km.

As shown in the above test records, by using the inventive vacuum advance regulator power efficiency is improved, and a fuel savings of more than 20 percent was noted under similar driving conditions.

While the invention has been described in complete detail and pictorially shown in the accompanying drawings, it is not to be limited to such details, since many changes and modifications may be made to the invention without departing from the spirit and the scope thereof. Hence, it is described to cover any and all modifications and forms which may come within the language and scope of the claims.

I claim:

1. A vacuum advance regulator for an internal combustion engine having spark timing comprising:

(a) a body having a first bore and a second bore, (b) a vacuum chamber located within said body and connected to the outside of said body by means of a nipple extending from one side of said chamber through the first bore and a nipple extending from the other side of said chamber through the second bore where the other side of the nipple attached to the first bore is connected by means of a vacuum hose to a carburetor and where the other side of the nipple attached to the second bore is connected by means of a vacuum hose to a vacuum advancer, (c) a first adjustable throttle connected in-line with said nipple extending from the first bore, (d) adjustable throttle in communication with said vacuum chamber, atmosphere and with said first throttle where said first and second throttles allow adjustment to set the spark timing, and (e) wherein said first and second throttles are set to provide spark timing control in accordance with the following equation:

$$\theta(BTDC) = \frac{\left(\beta \times \frac{L}{350} - \beta\right)}{\pi} + \beta$$

where:

$\theta$(BTDC)=angle before top dead center (°)

$\beta$=substitution parameter for engine speed in revolutions per minute

L=exhaust volume divided by the number of cylinder in cubic centimeters (cc)

$\pi$=Pi or 3.1416.

2. The vacuum advance regulator as specified in claim 1 further comprising an air filter that is connected in-line with said second throttle.

* * * * *